US011312598B2

(12) United States Patent
Whaley et al.

(10) Patent No.: US 11,312,598 B2
(45) Date of Patent: Apr. 26, 2022

(54) HOIST FLEET ASSEMBLY

(71) Applicant: Wenger Corporation, Owatonna, MN (US)

(72) Inventors: Christopher D. Whaley, Phoenix, NY (US); Peter V. Svitavsky, Port Byron, NY (US); Maximilian J. Sauer, Rochester, NY (US); Alvah Benjamin Aldrich, Geneva, NY (US)

( * ) Notice: Subject to any disclaimer, the term of this patent is extended or adjusted under 35 U.S.C. 154(b) by 147 days.

(21) Appl. No.: 16/822,869

(22) Filed: Mar. 18, 2020

(65) Prior Publication Data

US 2020/0299113 A1 Sep. 24, 2020

Related U.S. Application Data

(60) Provisional application No. 62/819,791, filed on Mar. 18, 2019.

(51) Int. Cl.

| | |
|---|---|
| ***B66D 1/36*** | (2006.01) |
| ***B66D 3/06*** | (2006.01) |
| ***A63J 1/02*** | (2006.01) |
| ***B66D 3/08*** | (2006.01) |
| ***B66D 3/04*** | (2006.01) |

(52) U.S. Cl.

CPC ..... *B66D 1/36* (2013.01); *A63J 1/028* (2013.01); *B66D 3/043* (2013.01); *B66D 3/06* (2013.01); *B66D 3/08* (2013.01)

(58) Field of Classification Search

CPC ..... B66D 2700/028; B66D 3/06; B66D 3/04; B66D 3/08; B66D 3/043; B66D 1/36; A63J 1/028

See application file for complete search history.

(56) References Cited

U.S. PATENT DOCUMENTS

| | | | | |
|---|---|---|---|---|
| 125,882 A * | 4/1872 | Clemons et al. | ..... | B66D 1/36 254/395 |
| 1,507,712 A * | 9/1924 | Produfoot | ..... | B66B 7/06 254/338 |
| 1,833,172 A * | 11/1931 | Minor | ..... | B66D 3/06 254/398 |

(Continued)

FOREIGN PATENT DOCUMENTS

| | | |
|---|---|---|
| EP | 0 395 980 B1 | 11/1990 |
| EP | 0 822 159 B1 | 2/1998 |

*Primary Examiner* — Michael E Gallion

(74) *Attorney, Agent, or Firm* — Patterson Thuente Pedersen, P.A.

(57) ABSTRACT

Described herein is a hoist fleet system including a head block and a guide fleet assembly. The head block includes a plurality sheaves having more than one diameter. The guide fleet assembly can be arranged proximate the head block such that an array of lift lines can be routed through the plurality of sheaves of the head block into the guide fleet assembly. The guide fleet assembly further includes a plurality of guide sheaves and a plurality of plates. The plurality of plates is configured to house the plurality of guide sheaves. The plurality of guide sheaves is positioned substantially orthogonal to the head block. The plurality of plates is further arranged such that the plurality of guide sheaves is arranged on more than one plane. The plurality of guide sheaves is configured to reduce the spacing of the lift lines.

22 Claims, 8 Drawing Sheets

(56) References Cited

U.S. PATENT DOCUMENTS 2,239,493 A * 4/1941 Nichols ..... B66D 3/06 254/399
2,259,253 A * 10/1941 Kozlovskis ..... B66D 3/06 254/399
2,601,611 A * 6/1952 Hilborn ..... B66D 3/06 254/399
3,050,286 A * 8/1962 Seamans ..... B66D 3/04 254/401
3,258,249 A * 6/1966 Williams ..... B66D 3/043 254/399
3,345,066 A 10/1967 Izenour
3,786,935 A * 1/1974 Vlazny ..... B66D 3/06 212/274
3,854,592 A * 12/1974 Mordre ..... B66D 3/043 212/226
3,940,112 A * 2/1976 Lea ..... B66D 3/08 254/399
4,069,921 A * 1/1978 Raugulis ..... B66C 1/34 212/274
7,562,863 B2 7/2009 Kochan et al.
1,002,839 A1 9/2011 Hagen
8,317,159 B2 * 11/2012 Hoffend, III ..... B66D 1/741 254/286
9,056,751 B2 * 6/2015 Roodenburg ..... B66D 3/08
9,616,357 B2 4/2017 Sowka et al.
9,856,118 B1 * 1/2018 Lin ..... B66C 1/40
10,227,221 B2 * 3/2019 Hoffend, III ..... B66D 1/38
2003/0227186 A1 * 12/2003 Eiwan ..... B66D 3/043 294/82.11
2006/0163548 A1 * 7/2006 Kochan ..... B66D 5/14 254/278
2006/0284151 A1 * 12/2006 Hossler ..... B66D 1/26 254/278
2013/0181177 A1 7/2013 Moll
2019/0135596 A1 * 5/2019 Whaley ..... B66D 5/16

* cited by examiner

HOIST FLEET ASSEMBLY

CROSS-REFERENCE TO RELATED APPLICATION

The present application claims the benefit of U.S. Provisional Application No. 62/819,791, filed Mar. 18, 2019, which is hereby incorporated herein in its entirety by reference.

TECHNICAL FIELD

The present invention relates to hoist fleet systems and assemblies. In particular, the present invention relates to fleet guiding systems for use with a hoist drive system.

BACKGROUND

Hoists, battens, and trusses are a critical element of performance venues such as theaters, concert halls, and auditoriums to move, elevate, or lower scenery, lighting, and other equipment around the venue. Modern venues use motorized hoist systems to manipulate scenery, lighting, and other equipment around a stage area of a venue. A venue will generally have a series of motorized hoist systems mounted to joists, beams, or other structural members around a stage area. Each motorized hoist system generally facilitates an array of lift lines for each piece of equipment. For example, a scenery background hung from a batten may require seven lift lines in order to smoothly and safely manipulate the batten. Depending on the height of the stage, the batten may need to raise or lower up to ninety feet.

A hoist system conventionally includes a motorized drive drum configured to spool the plurality of lift lines. A hoist system, including seven lift lines travelling ninety feet, requires a drive drum that includes seven separate spooling grooves for each lift line. A minimum spacing between each lift line is required to safely spool the lift lines in a raised position. Often, the spacing between each lift line is five to ten times the diameter of the lift line. For example, a 0.1875-inch wire rope lift line would require spool spacing greater than 1.25 inches measured from centerline-to-centerline. Prior to the lift lines coupling to the batten, the array of lift lines travels through a loft block. The loft block includes an array of grooved sheaves configured to space the lift lines for coupling to the batten. The centerline-to-centerline spacing of the grooved sheaves in the loft block can be as little as 1.25 to 3 times the diameter of each lift line. Using the same 0.1875-inch wire rope lift line, the spacing between lift lines at the loft block can be as little as 0.23 inches. The change in lift line spacing between the drive drum and the loft block creates an issue with respect to acceptable fleet angles.

The fleet angle is the maximum angle the wire rope can have with respect to the plane of rotation of a sheave or drum. Fleet angle is an important metric for determining wire rope wear and, consequently, safety. The maximum fleet angle for grooved sheaves and drums is generally 1.5 degrees for wire rope. In order for a hoist system, such as the aforementioned system, to operate with lift line fleet angles less that 1.5 degrees, the motorized drive drum needs to be mounted at large distances from the loft block and batten.

The space and infrastructure needed to facilitate multiple lift line hoist systems that have fleet angles that do not exceed 1.5 degrees is often significant. The space requirements often become limiting for smaller venues, especially when more than one hoist systems are being used.

SUMMARY

The hoist fleet system incorporates a head block using numerous sheave diameters to create a multi-layered lift line path design wherein each layer utilizes fleet angle transitions to which layering occurs and for accurate positioning of individual lines. Multiple planes of lift lines are achieved by combining a series of varied diameter sheaves through the head block, at a defined spacing, to maximize the fleet transitions from the drum assembly within the hoist system. The lift lines exit the head block and transition into a series of individual sheaves on multiple planes which are at 90-degree groove angle to the head block sheaves. The lift lines are then routed through a loft block at the exit of the hoist fleet system. The hoist fleet system transitions the lift lines from the drum spacing down into a spacing matching the exit sheave or standard industry loft blocks spacing in a condensed space while maintaining a maximum fleet angle of 1.5 degrees.

One embodiment includes a hoist fleet system including a head block and a guide fleet assembly. The head block includes a plurality sheaves having more than one diameter. The guide fleet assembly can be arranged proximate the head block such that an array of lift lines can be routed through the plurality of sheaves of the head block into the guide fleet assembly. The guide fleet assembly further includes a plurality of guide sheaves and a plurality of plates. The plurality of plates is configured to house the plurality of guide sheaves. The plurality of guide sheaves is positioned substantially orthogonal to the head block. The plurality of plates is further arranged such that the plurality of guide sheaves is arranged on more than one plane. The plurality of guide sheaves is configured to reduce the spacing of the lift lines.

In an alternative embodiment, a hoist system comprising a hoist housing is disclosed. The hoist system also includes a hoist drive assembly including a motorized drive drum. The hoist drive system can be housed by the hoist housing. The hoist system further included a hoist fleet system coupled to the hoist housing. The hoist fleet system including a head block and a guide fleet assembly. The head block includes a plurality sheaves having more than one diameter. The guide fleet assembly can be arranged proximate the head block such that an array of lift lines can be routed through the plurality of sheaves of the head block into the guide fleet assembly. The guide fleet assembly further includes a plurality of guide sheaves and a plurality of plates. The plurality of plates is configured to house the plurality of guide sheaves. The plurality of guide sheaves is positioned substantially orthogonal to the head block. The plurality of plates is further arranged such that the plurality of guide sheaves is arranged on more than one plane. The plurality of guide sheaves is configured to reduce the spacing of the lift lines.

In an alternative embodiment, a hoist fleet system includes a head block, a guide fleet assembly and a loft block. The head block includes a plurality sheaves having more than one diameter. The guide fleet assembly can be arranged, at a first end, proximate the head block such that an array of lift lines can be routed through the plurality of sheaves of the head block into the guide fleet assembly. The guide fleet assembly further includes a plurality of guide sheaves and a plurality of plates. The plurality of plates is configured to house the plurality of guide sheaves. The plurality of guide sheaves is positioned substantially orthogonal to the head block. The plurality of plates is further arranged such that the plurality of guide sheaves is arranged on more than one plane. The plurality of guide sheaves is configured to reduce the spacing of the lift lines. The loft block can be arranged proximate a second end of the guide fleet assembly. The loft block includes a sheave block wherein the sheave block is configured to route the lift lines exiting the second end of the guide fleet assembly.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
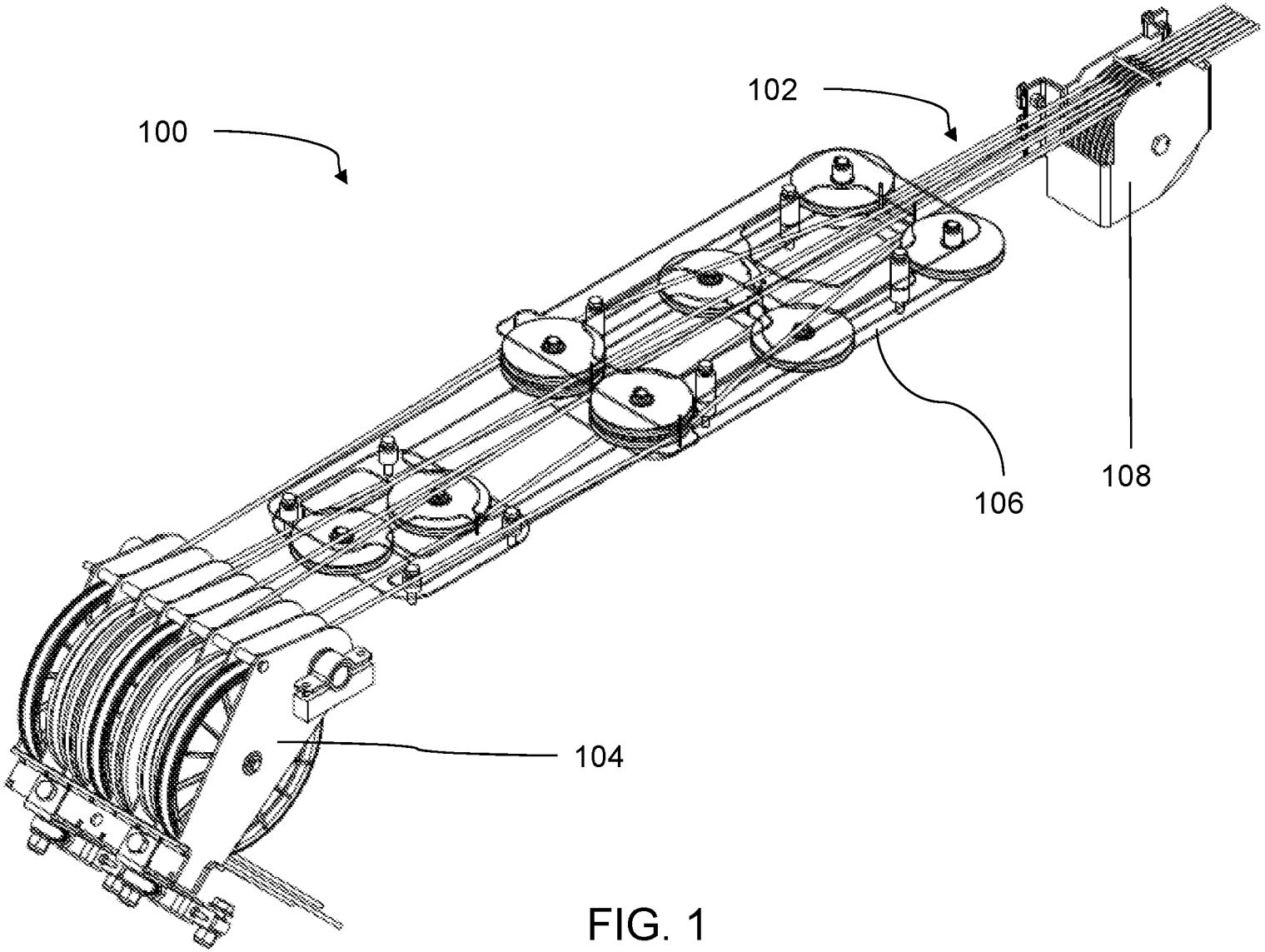
FIG. 1 is an isometric view of a hoist fleet system according to embodiments described herein.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Disclosed herein is are embodiments of a hoist fleet system configured to guide a set of lift lines from a motorized drive drum to a standard loft block without exceeding a 1.5 degree fleet angle on any lift line. The hoist fleet system includes a head block, a loft block, and a guide fleet assembly wherein the guide fleet assembly is arranged between the head block and the loft block. The guide fleet assembly includes a plurality of sheaves, arranged orthogonal to the head block, and arranged such that the lift line spacing is reduced without exceeding a fleet angle of 1.5 degrees.

As depicted in FIG. 1, a hoist fleet system 100 is configured for guiding a set of lift lines 102. Hoist fleet system 100 can include a head block 104, a guide fleet assembly 106 and a loft block 108. Head block 104 is configured to couple to a housing of a hoist drive system. Head block 104 is further configured to receive lift lines 102 from a hoist drive drum and route lift lines 102 to guide fleet assembly 106. Guide fleet assembly 106 is arranged between head block 104 and loft block 108. Guide fleet assembly 106 is configured to reduce the spacing of the lift lines from drive drum spacing to loft block spacing. Loft block 108 is configured to receive lift lines 102 from guide fleet assembly 106 and route lift lines 102 to a batten or other piece of equipment.

Unless otherwise indicated, hoist fleet system 100 includes structural and hardware components made of steel or other suitable material. Sheaves, and other lift line engaging surfaces can be made of glass-filled nylon 6-6, such as Nylatron GS™, or other suitable materials. Plain bearing materials can be made of bronze or other suitable bearing material. Roller bearings can be made of ceramic, steel, or other suitable material.

Figure 2A:
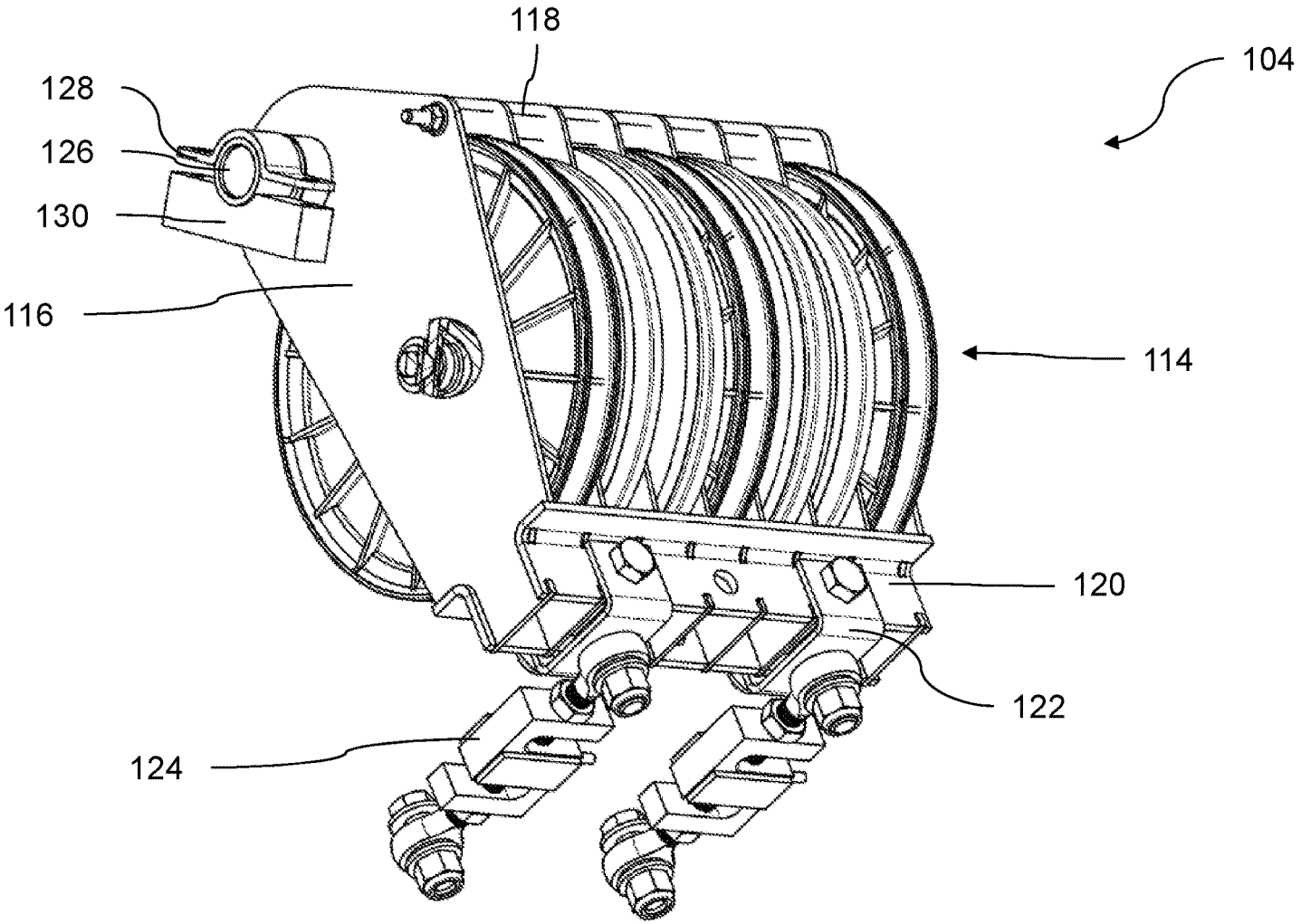
FIG. 2A is an isometric view of a head block of the hoist fleet system depicted in FIG. 1.
Figure 2B:
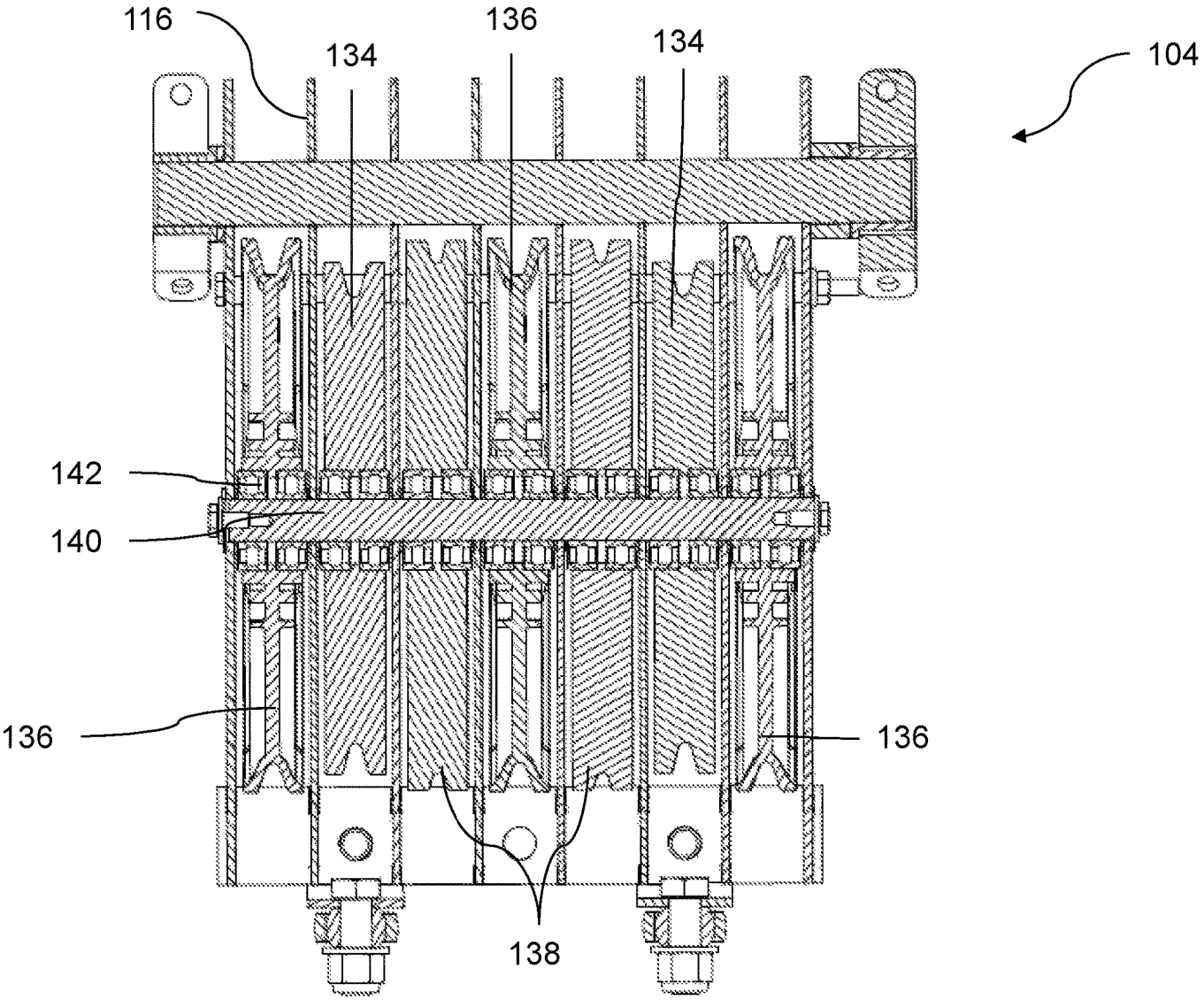
FIG. 2B is a cross-section view of the head block depicted in FIG. 2A.

Referring now to FIGS. 2A and 2B, head block 104 includes an array of sheaves 114 and a plurality of side plates 116. Side plates 116 are arranged such that they flank each sheave within the array of sheaves 114. Side plates 116 are a positioned on either side of each sheave with spacers 118 and one or more plate brackets 120. One or more plate brackets 120 are coupled to a load cell bracket 122. Load cell bracket 122 is configured to compress two plate brackets 120 around side plates 116. Load cell bracket 122 also includes an aperture or threaded post such that a load cell 124 can be coupled to each load cell bracket 122 at a first end of each load cell 124. Each load cell 124 is couplable at a second end to the housing of the hoist system.

In embodiments, side plates 116 are arranged at a first end, into slots or grooves of one or more plate brackets 120. At a second end, side plates 116 are coupled using a threaded nut and elongated bolt with spacers 118 disposed between each side plate 116. Side plate 116 further includes an aperture, arranged proximate the second end, configured to receive a mounting shaft 126. Mounting shaft 126 is configured to support head block 104 at the second end. Head block 104 further includes a mounting strap 128 and a mounting bracket 130 arranged at each end of mounting shaft 126. Mounting bracket 130 and mounting strap 128 are configured to couple together such that mounting shaft 126 is retained between mounting bracket 130 and mounting strap 128. Mounting bracket 130 is configured to couple to the housing of the hoist drive system. Mounting bracket 130 and mounting strap 128 are arranged to allow mounting shaft 126 to rotate therein.

The one or more load cells 124 are communicatively coupled to a controller. Load cells 124 are configured to measure forces being applied to the array of sheaves 114. Because mounting bracket 130 and mounting strap 128 allow mounting shaft 126 to rotate freely, with the exception of minimal journal bearing friction, the forces placed on load cells 124 are resultant of forces placed on sheaves 114. Thus, load cells 124 can relay accurate load information to the controller such that safe operating loads can be maintained.

Referring now to FIG. 2B in particular, the array of sheaves 114 can include small sheaves 134, medium sheaves 136, and large sheaves 138. Each of the sheaves 114 include a central aperture and an exterior groove sized and shaped to guide lift lines 102. Small sheaves 134, medium sheaves 136, and large sheaves 138 can vary in construction including solid sheave construction, molded sheave construction, or any other construction method. For example, and as depicted in FIG. 2B, medium sheaves 136 are constructed by an injection molding process and therefore include thinner walls and various rib support structures. Small sheaves 134 and large sheaves 138 are constructed using solid material that is machined to form. It is appreciated that all size sheaves can be constructed using any variety of suitable methods.

Sheaves 114 are rotatably coupled to a sheave shaft 140 via roller bearings 142. Sheave shaft 140 couples, at both ends, to side plates 116. Small sheaves 134, medium sheaves 136, and large sheaves 138 can vary in size such that lift lines exit head block 104 at different horizontal planes corresponding to the difference in diameters of the small sheaves 134, medium sheaves 136, and large sheaves 138. For example, lift lines guided by small sheaves 134 exit head block 104 on a lower horizontal plane than the lift lines guided by medium sheaves 136, and large sheaves 138. Likewise, lift lines guided by large sheaves 138 exit head block 104 on a higher horizontal plane than the lift lines guided by medium sheaves 136, and small sheaves 134. And finally, lift lines guided by medium sheaves 136 exit head block 104 on a mid-plane located between the upper plane of the large sheaves 138 and the lower plane of the small sheaves 134.

It is appreciated that any number of different sized sheaves, including small sheaves 134, medium sheaves 136, and large sheaves 138, and any other suitable sizes, can be combined in any quantity and combination to achieve any number of planes of lift lines.

Figure 3A:
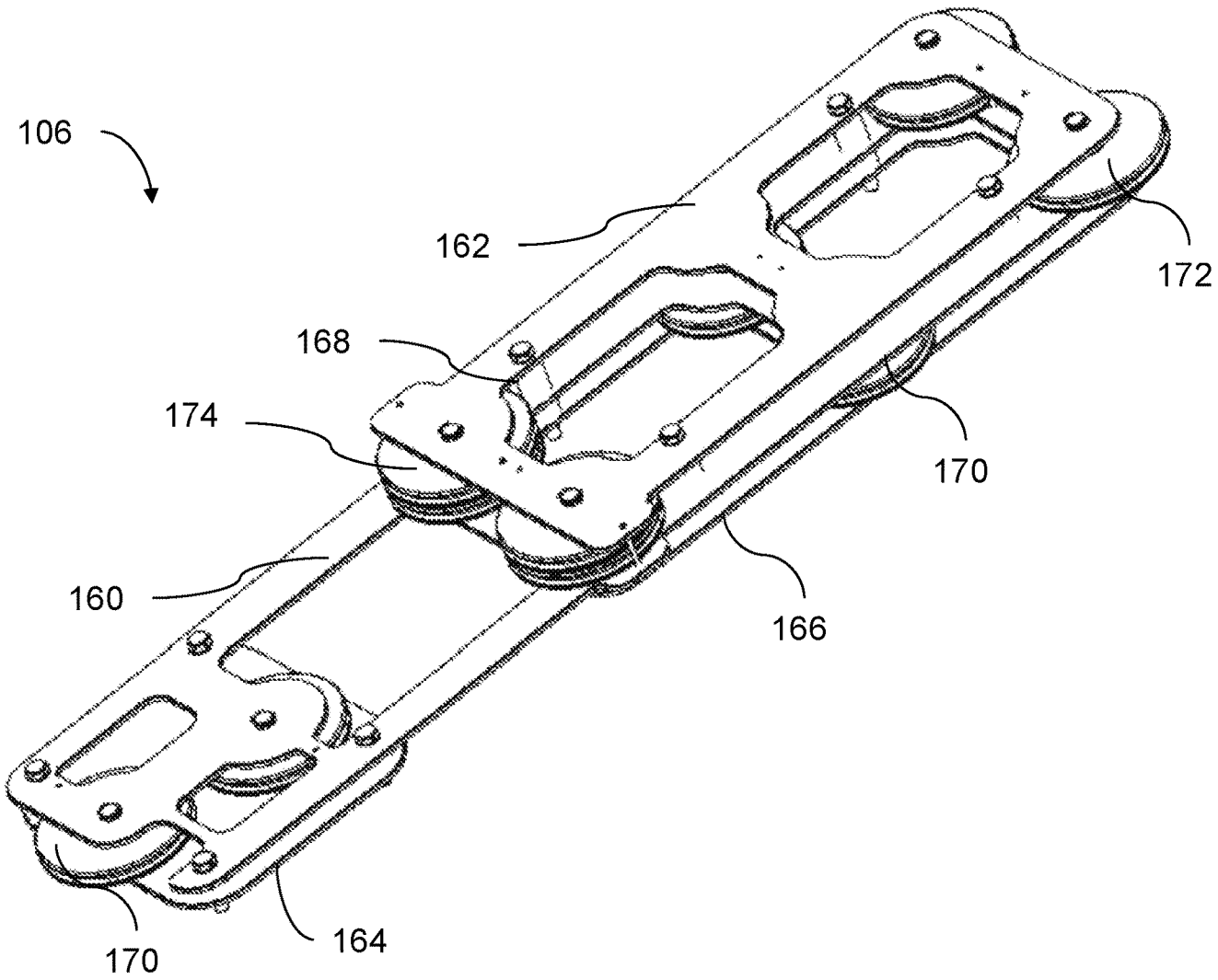
FIG. 3A is an isometric view of a guide fleet assembly of the hoist fleet system depicted in FIG. 1.
Figure 3B:
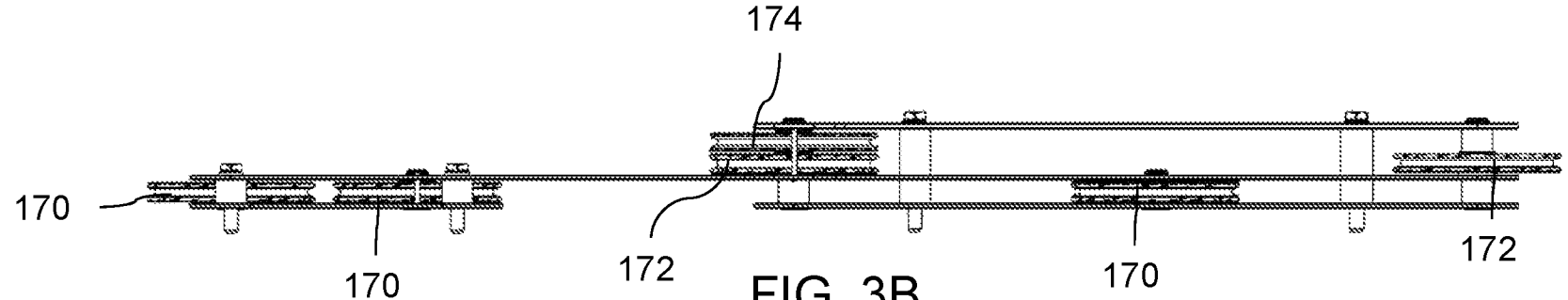
FIG. 3B is a side view of the guide fleet assembly depicted in FIG. 3A.
Figure 3C:
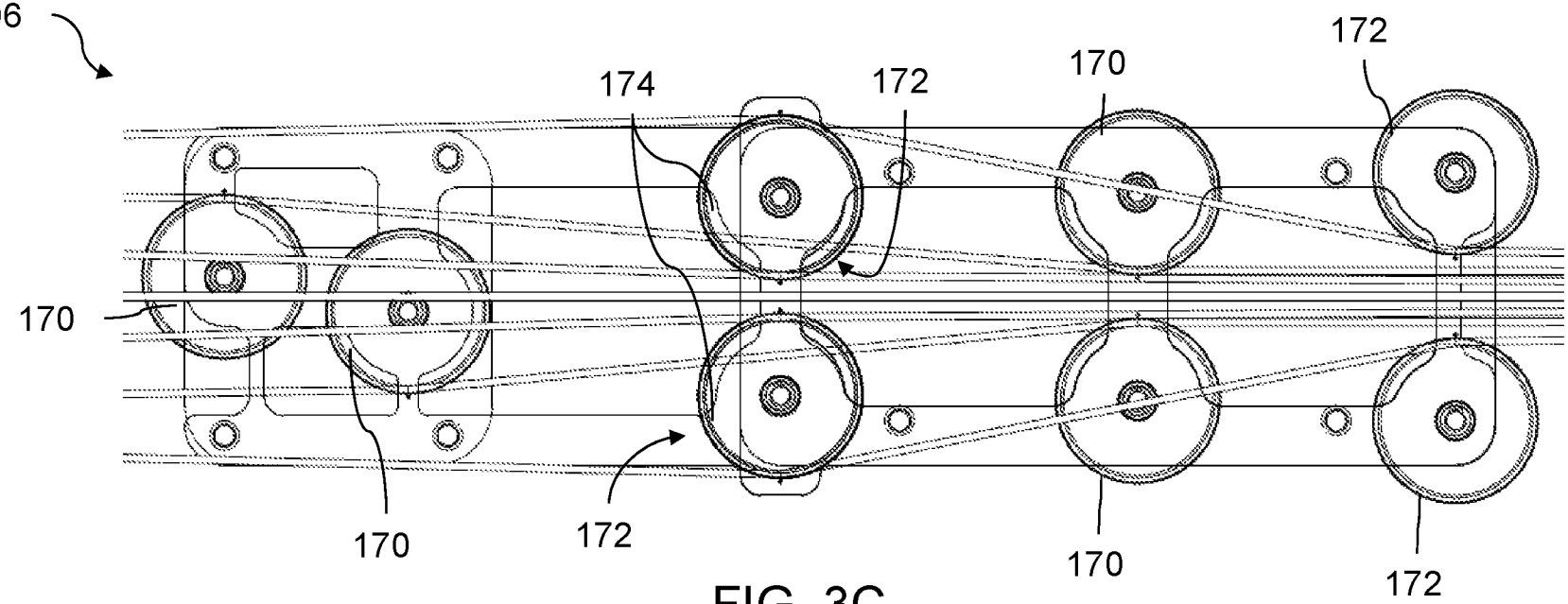
FIG. 3C is a top view of the guide fleet assembly depicted in FIG. 3A.

Referring now to FIGS. 3A-3C, guide fleet assembly 106 includes a main plate 160, top plate 162, a first lower plate 164 and a second lower plate 166. Each of main plate 160, top plate 162, a first lower plate 164 and a second lower plate 166 can comprise stamped steel construction with a plurality of weight saving apertures. Guide fleet assembly 106 also includes a plurality of lower sheaves 170, mid-sheaves 172, and upper sheaves 174.

In embodiments, first lower plate 164 couples to main plate 160 at a first portion of main plate 160 via threaded fasteners and a set of spacers 168. First lower plate 164 and main plate 160 are configured to house one or more lower sheaves 170 such that lower sheaves 170 are coupled to first lower plate 164 and main plate 160. Lower sheaves 170 rotate freely around a coupling axis via bearing. Second lower plate 166 couples to main plate 160 at a second portion of main plate 160 via threaded fasteners and spacers 168. Second lower plate 166 and main plate 160 are configured to house one or more lower sheaves 170 such that lower sheaves 170 are rotatably coupled to second lower plate 166 and main plate 160.

Top plate 162 couples to the second portion of main plate 160 opposite second lower plate 166 via threaded fasteners and spacers 168. Top plate 162 and main plate 160 are configured to house one or more mid-sheaves 172 and upper sheaves 174. In some configurations, mid-sheaves 172 and upper sheaves 174 can be stacked as well as arranged individually, as is depicted in FIG. 3B.

In one embodiment, and referring to FIGS. 3B and 3C, lower sheaves 170, mid-sheaves 172, and upper sheaves 174 are arranged at various locations on three different horizontal planes in order to receive lift lines exiting sheaves 114 of head block 104. In particular, lower sheaves 170 are configured to receive lift lines running on the lower plane guided by small sheaves 134. Mid-sheaves 172 are configured to receive lift lines running on the mid-plane guided by medium sheaves 136. Upper sheaves 174 are configured to receive lift lines running on the upper plane guided by large sheaves 138. Lower sheaves 170, mid-sheaves 172, and upper sheaves 174 are arranged on each plane such that each lift line is guided closer together such that all lift lines exit guide fleet assembly 106 in load block spacing.

Figure 4:
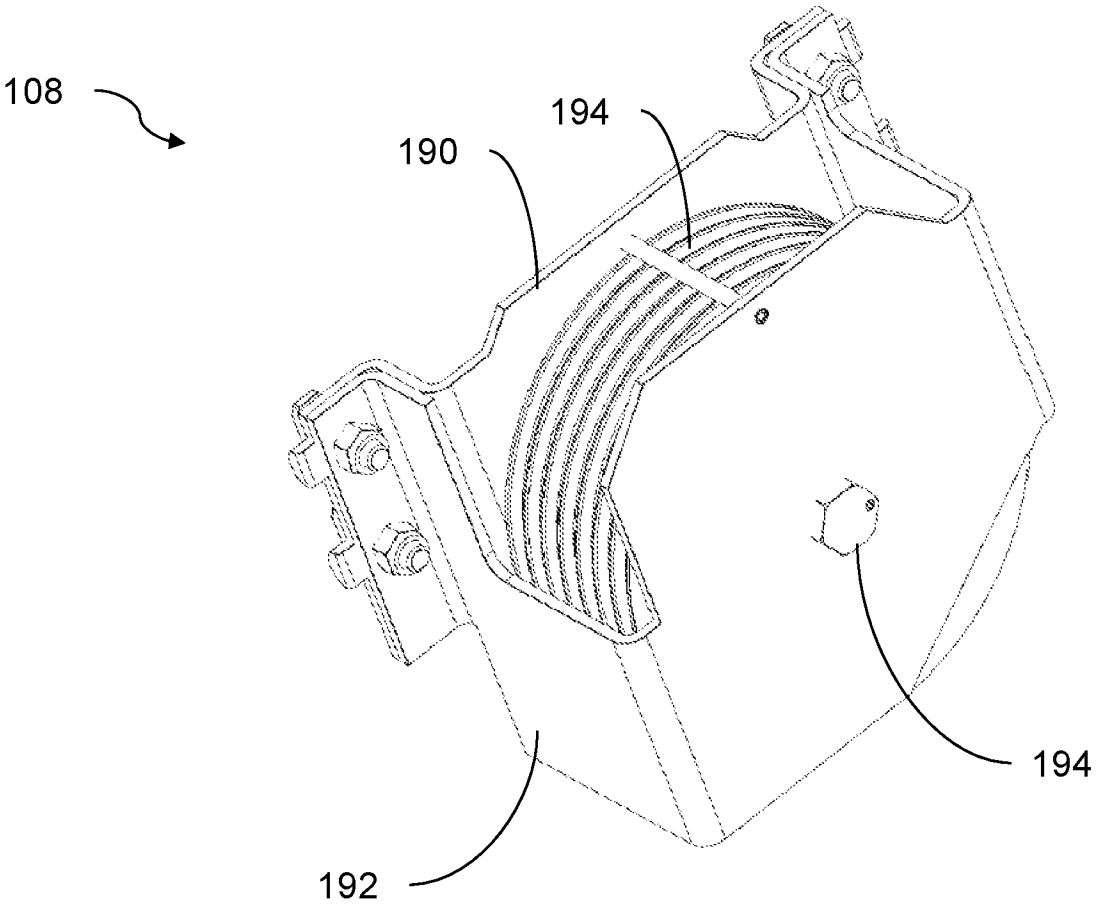
FIG. 4 is an isometric view of a loft block of the hoist fleet system depicted in FIG. 1.

Referring now to FIG. 4, loft block 108 includes a loft mounting bracket 190, sheave block housing 192, and loft block sheaves 194. Sheave block housing 192 couples to loft mounting bracket 190 such that loft block sheaves 194 are retained therein via shaft 196. Loft block 108 is configured to couple to the housing of a hoist drive system or a support structure separate from the hoist system. Loft block sheaves 194 are configured to receive lift lines 102 exiting guide fleet assembly 106 and route lift lines 102 to a batten or other piece of equipment.

Figure 5:
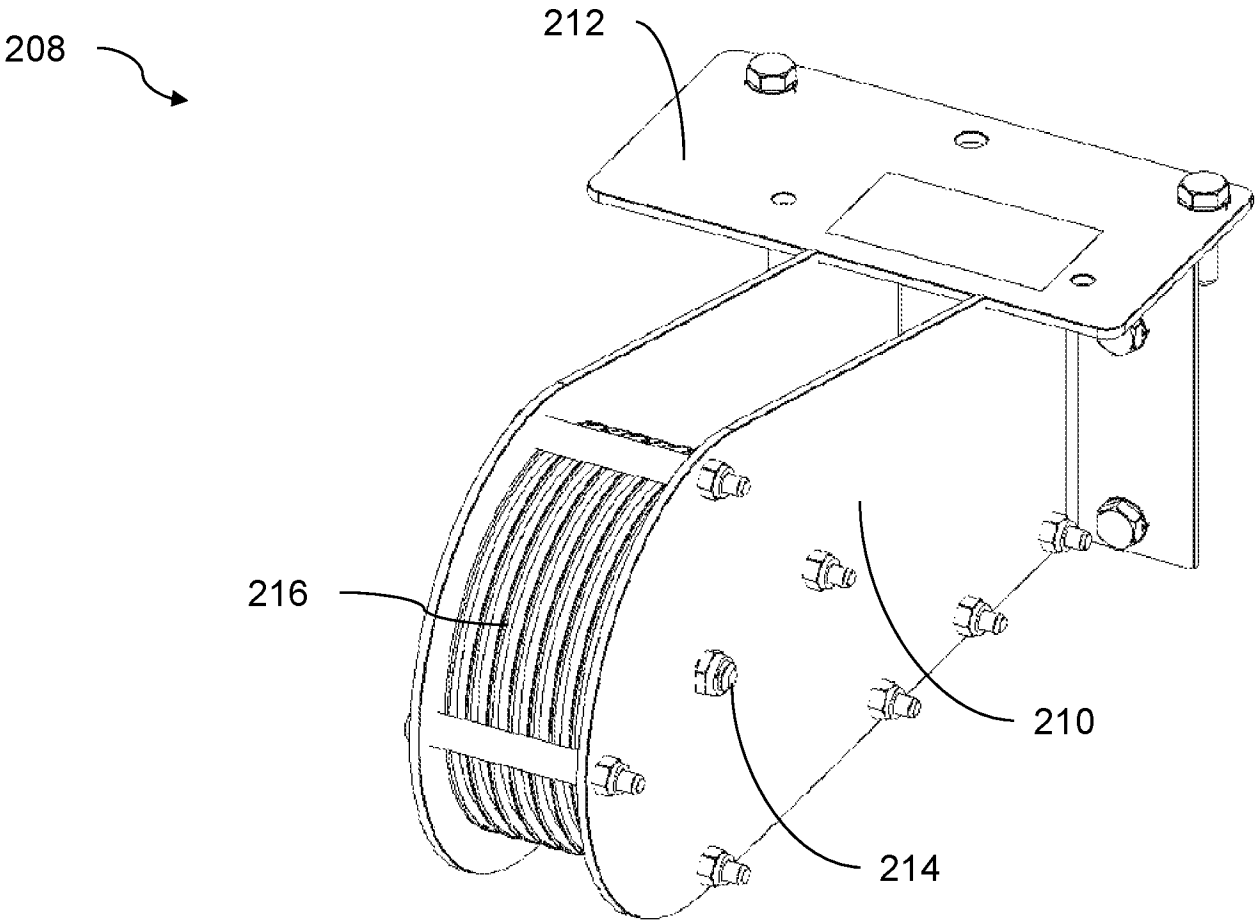
FIG. 5 is an isometric view of an idler block assembly according to embodiments described herein.

Referring now to FIG. 5, an idler block assembly 208 can serve as an alternative to loft block 108 when the hoist system is arranged in a vertical orientation. Idler block assembly 208 includes side brackets 210, a side mount bracket 212, a shaft 214 and sheave block 216. Side brackets 210 couple together via threaded fasteners and spacers such that sheave block 216 is retained therein via shaft 214. Side mount bracket 212 is coupled to side brackets 210 and is further configured to couple to a vertical support member. Sheave block 216 is configured to receive lift lines 102 exiting guide fleet assembly 106 and route lift lines 102 to a batten or other piece of equipment.

Figure 6A:
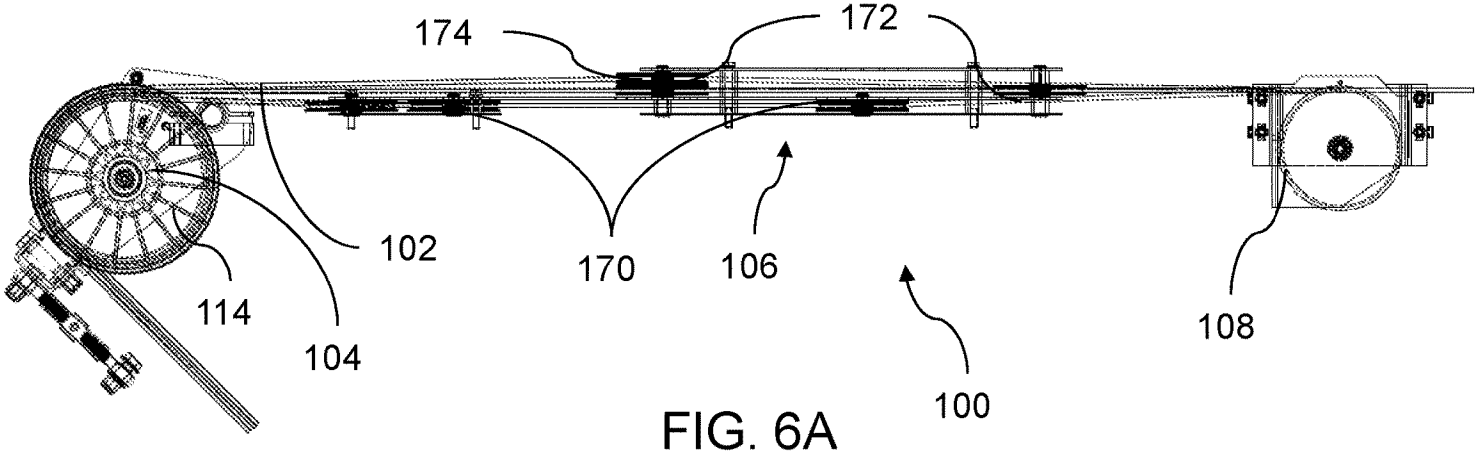
FIG. 6A is a side view of the hoist fleet system depicted in FIG. 1.
Figure 6B:
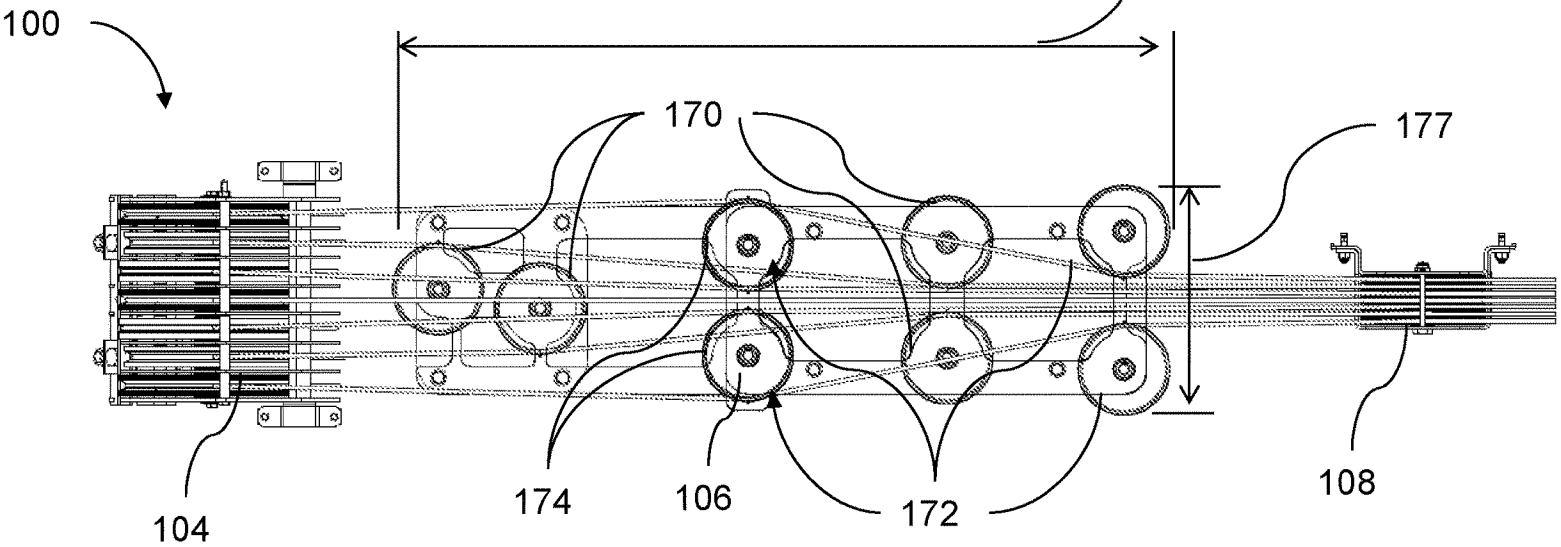
FIG. 6B is a top view of the hoist fleet system depicted in FIG. 1.

In use, and referring now to FIGS. 6A and 6B, a plurality of lift lines 102, originating from a drive drum of a hoist system, are routed through the array of sheaves 114 of head block 104. Each lift line 102 is routed around one of small sheave 134, medium sheave 136, or large sheave 138 as depicted in FIG. 2B. Lift lines 102 can be routed around small sheaves 134 exit head block 104 on the lower plane and are routed through lower sheaves 170 of guide fleet assembly 106. Lift lines 102 can be routed around medium sheaves 136 exit head block 104 on the mid-plane and are routed through mid-sheaves 172 of guide fleet assembly 106. Lift lines 102 can be routed around large sheaves 138 exit head block 104 on the upper plane and are routed through upper sheaves 174 or guide fleet assembly 106. Lower sheaves 170, mid-sheaves 172, and upper sheaves 174 are arranged on guide fleet assembly 106 such that lift lines are received by guide fleet assembly 106 with large, drive drum spacing, and exit guide fleet assembly 106 in tighter, loft block spacing. This arrangement provides a maximum guide sheave width 177 that represents the maximum distance between the outermost guides sheaves taken perpendicular to the direction of travel of the lift lines. This arrangement also provides a maximum guide sheave length 178 that represents the maximum distance between the outermost guides sheaves taken parallel to the direction of travel of the lift lines.

In one embodiment as depicted in FIG. 6B, the central lift line is routed around a medium sheave 136 and passes through guide fleet assembly 106 without engaging any sheaves. The center flanking lift lines, located on either side of the center line, are routed around large sheaves 138 and, therefore, are routed through upper sheaves 174 on the upper plane of guide fleet assembly 106. Upper sheaves 174 guide the center flanking lift lines toward the center lift line. The exterior lift lines, i.e. the outer most lift lines, are routed around medium sheaves 136, and, therefore, are routed through mid sheaves 172 on the mid-plane of guide fleet assembly 106. The exterior lift lines are first guided outwardly by a first set of mid-sheaves 172 and are then guided inwardly by a second set of mid-sheaves 172. The inner lift lines, i.e., the lift lines just inside the exterior lift lines, are routed around small sheaves 134 and, therefore, are routed through lower sheaves 170 on the lower plane of guide fleet assembly 106. The inner lift lines are first guided outwardly by a first set of lower sheaves 170 and are then guided inwardly by a second set of lower sheaves 170.

With the aforementioned configuration of sizing of sheaves in the head block 104 and the arrangement of sheaves in the guide fleet assembly 106, lift lines 102 can be reduced from drive drum spacing to loft line spacing in a space of 20 inches given a 7-line configuration of 0.1875 inch wire rope lift lines and maintaining a maximum fleet angle of 1.5 degrees. In other embodiments, different head block 104 sheave sizing and arrangement of sheaves in the guide fleet assembly 106 can result in reduction from drive drum spacing to loft line spacing in a space of 10 inches given a 7-line configuration of 0.1875 inch wire rope lift lines and maintaining a maximum fleet angle of 1.5 degrees.

The hoist fleet system 100 is designed to provide a smooth multi-level transition mechanism of the lift line for a hoist (or any device it can be attached to) when conditions exist or occur which would be potentially hazardous to the system; hoist, arbor, building or nearby people and/or operators of the system.

To further enhance the preciseness of the design the head block features load sensing from which the system detects load forces on the complete system at predetermined values designed to protect against conditions arising or occurring which would be potentially hazardous to the system; hoist, arbor, building or nearby people and/or operators of the system.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

For purposes of interpreting the claims, it is expressly intended that the provisions of 35 U.S.C. § 112(f) are not to be invoked unless the specific terms "means for" or "step for" are recited in a claim.

The invention claimed is:

1. A hoist fleet system comprising:

a head block including a plurality sheaves, the plurality of sheaves having more than one diameter;

a guide fleet assembly arranged proximate the head block such that an array of lift lines can be routed through the plurality of sheaves of the head block into the guide fleet assembly, the guide fleet assembly including:

a plurality of guide sheaves, a plurality of plates configured to house the plurality of guide sheaves, the plurality of guide sheaves coupled to the plates such that the plurality of guide sheaves are positioned substantially orthogonal to the head block, the plurality of plates further arranged such that the plurality of guide sheaves are arranged on more than one plane; and wherein the plurality of guide sheaves are configured to reduce the spacing of the lift lines.

2. The hoist fleet system of claim 1, wherein the plurality of sheaves of the head block includes small sheaves, medium sheaves, and large sheaves.

3. The hoist fleet system of claim 1, wherein the plurality of guide sheaves is arranged on planes corresponding to the different diameters of the plurality of sheaves of the head block.

4. The hoist fleet system of claim 2, wherein the plurality of guide sheaves are arranged on a lower plane, a mid-plane, and an upper plane, the guide sheaves arranged on the lower plane corresponding to the small sheaves of the head block, the guide sheaves arranged on the upper plane corresponding to the medium sheaves of the head block, and the guide sheaves arranged on the upper plane corresponding to the large sheaves of the head block.

5. The hoist fleet system of claim 1, wherein the plurality of sheaves of the head block includes small sheaves and large sheaves.

6. The hoist fleet system of claim 5, wherein the plurality of guide sheaves are arranged on a lower plane and an upper plane, the guide sheaves arranged on the lower plane corresponding to the small sheaves of the head block and the guide sheaves arranged on the upper plane corresponding to the large sheaves of the head block.

7. A hoist system comprising:

a hoist housing;

a hoist drive assembly including a motorized drive drum, the hoist drive system housed by the hoist housing; and a hoist fleet system coupled to the hoist housing, the hoist fleet system including:

a head block including a plurality sheaves, the plurality of sheaves having more than one diameter, a guide fleet assembly arranged proximate the head block such that an array of lift lines can be routed through the plurality of sheaves of the head block into the guide fleet assembly, the guide fleet assembly including:

a plurality of guide sheaves;

a plurality of plates configured to house the plurality of guide sheaves, the plurality of guide sheaves coupled to the plates such that the plurality of guide sheaves are positioned substantially orthogonal to the head block, the plurality of plates further arranged such that the plurality of guide sheaves are arranged on more than one plane, and wherein the plurality of guide sheaves is configured to reduce the spacing of the lift lines.

8. The hoist system of claim 7, wherein the plurality of sheaves of the head block includes small sheaves, medium sheaves, and large sheaves.

9. The hoist system of claim 7, wherein the plurality of guide sheaves is arranged on planes corresponding to the different diameters of the plurality of sheaves of the head block.

10. The hoist system of claim 8, wherein the plurality of guide sheaves are arranged on a lower plane, a mid-plane, and an upper plane, the guide sheaves arranged on the lower plane corresponding to the small sheaves of the head block, the guide sheaves arranged on the upper plane corresponding to the medium sheaves of the head block, and the guide sheaves arranged on the upper plane corresponding to the large sheaves of the head block.

11. The hoist system of claim 7, wherein the plurality of sheaves of the head block includes small sheaves and large sheaves.

12. The hoist system of claim 11, wherein the plurality of guide sheaves are arranged on a lower plane and an upper plane, the guide sheaves arranged on the lower plane corresponding to the small sheaves of the head block and the guide sheaves arranged on the upper plane corresponding to the large sheaves of the head block.

13. A hoist fleet system comprising:

a head block including a plurality sheaves, the plurality of sheaves having more than one diameter;

a guide fleet assembly arranged, at a first end, proximate the head block such that an array of lift lines can be routed through the plurality of sheaves of the head block into the guide fleet assembly, the guide fleet assembly including:

a plurality of guide sheaves, a plurality of plates configured to house the plurality of guide sheaves, the plurality of guide sheaves coupled to the plates such that the plurality of guide sheaves are positioned substantially orthogonal to the head block, the plurality of plates further arranged such that the plurality of guide sheaves are arranged on more than one plane wherein the plurality of guide sheaves are configured to reduce the spacing of the lift lines; and a loft block arranged proximate a second end of the guide fleet assembly, the loft block including a sheave block, the sheave block configured to route the lift lines exiting the second end of the guide fleet assembly.

14. The hoist fleet system of claim 13, wherein the plurality of sheaves of the head block includes small sheaves, medium sheaves, and large sheaves.

15. The hoist fleet system of claim 13, wherein the plurality of guide sheaves is arranged on planes corresponding to the different diameters of the plurality of sheaves of the head block.

16. The hoist fleet system of claim 14, wherein the plurality of guide sheaves are arranged on a lower plane, a mid-plane, and an upper plane, the guide sheaves arranged on the lower plane corresponding to the small sheaves of the head block, the guide sheaves arranged on the upper plane corresponding to the medium sheaves of the head block, and the guide sheaves arranged on the upper plane corresponding to the large sheaves of the head block.

17. The hoist fleet system of claim 13, wherein the plurality of sheaves of the head block includes small sheaves and large sheaves.

18. The hoist fleet system of claim 17, wherein the plurality of guide sheaves are arranged on a lower plane and an upper plane, the guide sheaves arranged on the lower plane corresponding to the small sheaves of the head block and the guide sheaves arranged on the upper plane corresponding to the large sheaves of the head block.

19. The hoist fleet system of claim 13 comprising at least seven lift lines wherein the maximum distance between any two guide sheaves is less than 36 inches.

20. The hoist fleet system of claim 19 wherein the maximum distance between any two guide sheaves is less than 30 inches.

21. The hoist fleet system of claim 19 comprising a maximum guide sheave width wherein the maximum guide sheave width is less than 12 inches.

22. The hoist fleet system of claim 21 wherein the maximum guide sheave width is less than 10.5 inches.

* * * * *